US006371785B1

(12) United States Patent
Howell et al.

(10) Patent No.: US 6,371,785 B1
(45) Date of Patent: Apr. 16, 2002

(54) ZIF SOCKET WITH IMPROVED LEVER MECHANISM

(75) Inventors: David G. Howell, Gilbert, AZ (US); Fang-Chu Liao, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/874,445

(22) Filed: Jun. 4, 2001

(51) Int. Cl.[7] ..... H01R 4/50; H01R 13/625
(52) U.S. Cl. ..... 439/342
(58) Field of Search ..... 439/342, 264, 439/268, 263

(56) References Cited

U.S. PATENT DOCUMENTS 5,679,020 A * 10/1997 Lai et al. ..... 439/342

* cited by examiner

*Primary Examiner*—Brian Sircus
*Assistant Examiner*—Javaid Nasri
(74) *Attorney, Agent, or Firm*—Wei Te Chung

(57) ABSTRACT

A ZIF socket (100) includes an insulating base (2), a cover (1) slidably attached on the base, a lever mechanism (3) assembled between the base and the cover, and a plurality of contacts (4) received in the base. The cover has a pair of side walls (12) with a supporting piece (14) defined on one of the side walls. A restriction lug (141) projects from an end of the supporting piece. The lever mechanism includes a manual lever (31) and a cam shaft (30) connected to the manual lever at one end thereof. The manual lever defines an upper face (312) and a lower face (310). A rectangular recess (311) is defined on the lower face and receives the restriction lug of the cover for limiting a movement of the manual lever along a wrong operating direction so as to protect the manual lever from being damaged.

1 Claim, 4 Drawing Sheets

3

3

ZIF SOCKET WITH IMPROVED LEVER MECHANISM

BACKGROUND OF THE INVENTION

1. Field of the Invention

The present invention relates to a Zero Insertion Force (ZIF) socket, and particularly to a ZIF socket having an improved lever mechanism.

2. Description of Related Art

U.S. Pat. No. 5,679,020 discloses a conventional ZIF socket including a base and a cover slidably relatively moveable to the base, and a lever sandwiched between the base and the cover, wherein the lever includes a handle exposed to and accessible from outside and a cam shaft embedded within an upper half channel formed in the cover and a lower half channel formed in the base. However, the conventional ZIF socket could not protect the handle from being damaged by misuse in a wrong operating direction.

Hence, an improved ZIF socket is required to overcome the disadvantages of the conventional ZIF socket.

SUMMARY OF THE INVENTION

Accordingly, the object of the present invention is to provide a ZIF socket having an improved lever mechanism for protecting a handle of the lever mechanism from being moved in a lateral direction.

Another object of the present invention is to provide a ZIF socket having an improved cover for securely positioning a lever mechanism thereon.

In order to achieve the objects above mentioned, a ZIF socket adapted for retaining a chip, e.g. a Central Processing Unit chip, thereon, comprises an insulating base, a cover slidably attached on the base, a leve mechanism assembled between the base and the cover, and a plurality of contacts received in the insulating base. The cover has a side wall with a supporting piece defined thereon. A restriction lug projects from an end of the supporting piece. The lever mechanism is substantially L-shaped and includes a manual lever and a cam shaft connected to the manual lever at one end thereof The manual lever defines an upper face and a lower face thereon. A rectangular recess is defined on the lower face and receives the restriction lug of the cover for limiting a movement of the manual lever along a lateral direction so as to protect the manual lever from being damaged.

Other objects, advantages and novel features of the invention will become more apparent from the following detailed description when taken in conjunction with the accompanying drawings.

DETAILED DESCRIPTION OF THE INVENTION

Figure 1:
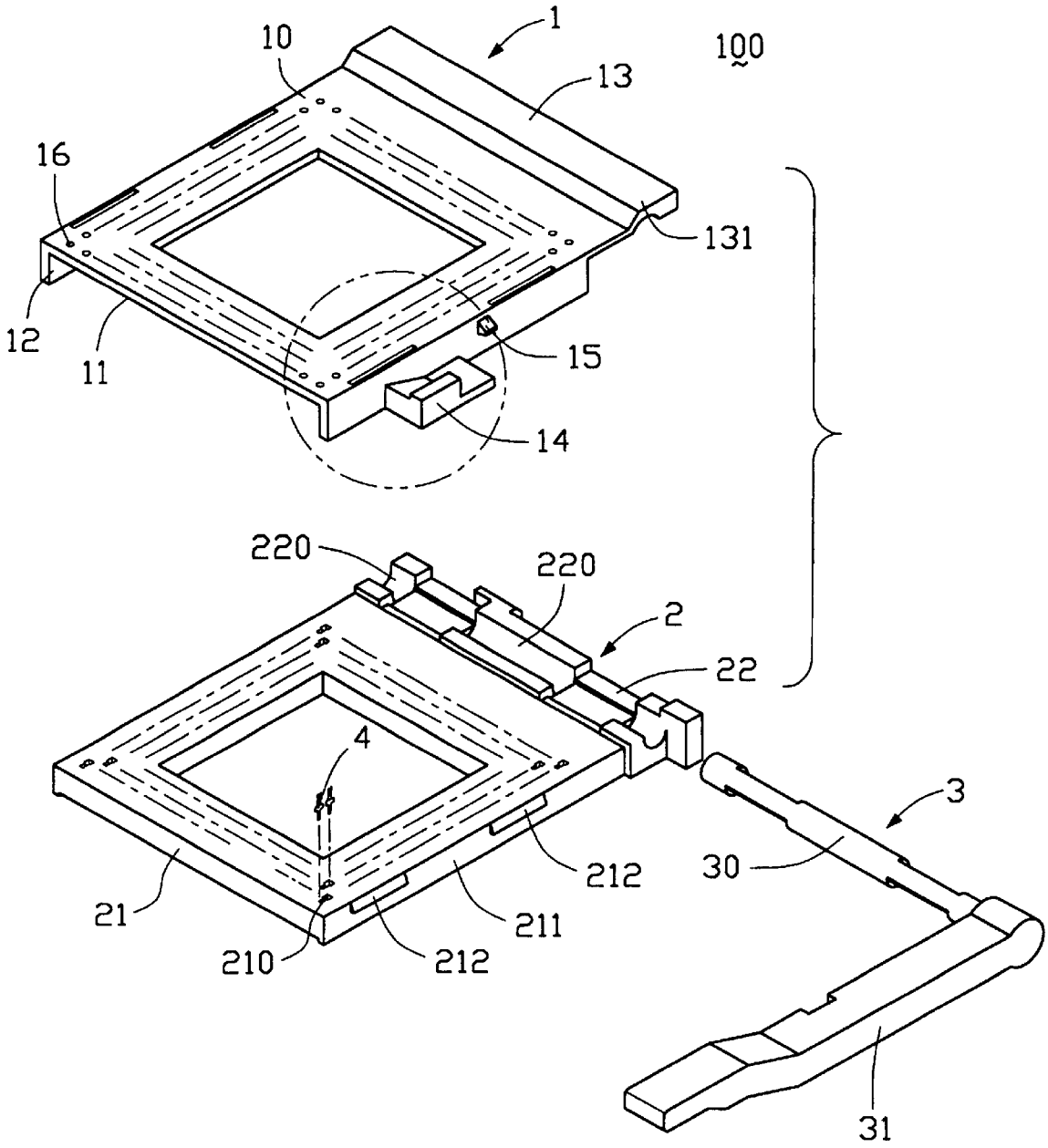
FIG. 1 is an exploded view of a ZIF socket in accordance with the present invention.

Reference will now be made to the drawing figures to describe the present invention in detail.

Referring to FIG. 1, a ZIF socket 100 of the present invention comprises an insulating base 2, a cover 1 slidably engaging on the insulating base 2, a lever mechanism 3 and a plurality of contacts 4 (only two shown) received in the base 2.

The insulating base 2 comprises a plate body 21 and a receiving portion 22 extending from a side edge of the plan body 21. A plurality of passageways 210 parallel to each other are defined in the plate body 21 for receiving corresponding contacts 4 therein. Each opposite side 211 of the plate body 21 perpendicular to the receiving portion 22 provides a pair of spaced elongate blocks 212. The receiving portion 22 defines a rounded channel 220 thereof for receiving the lever mechanism 3 therein.

Figure 2:
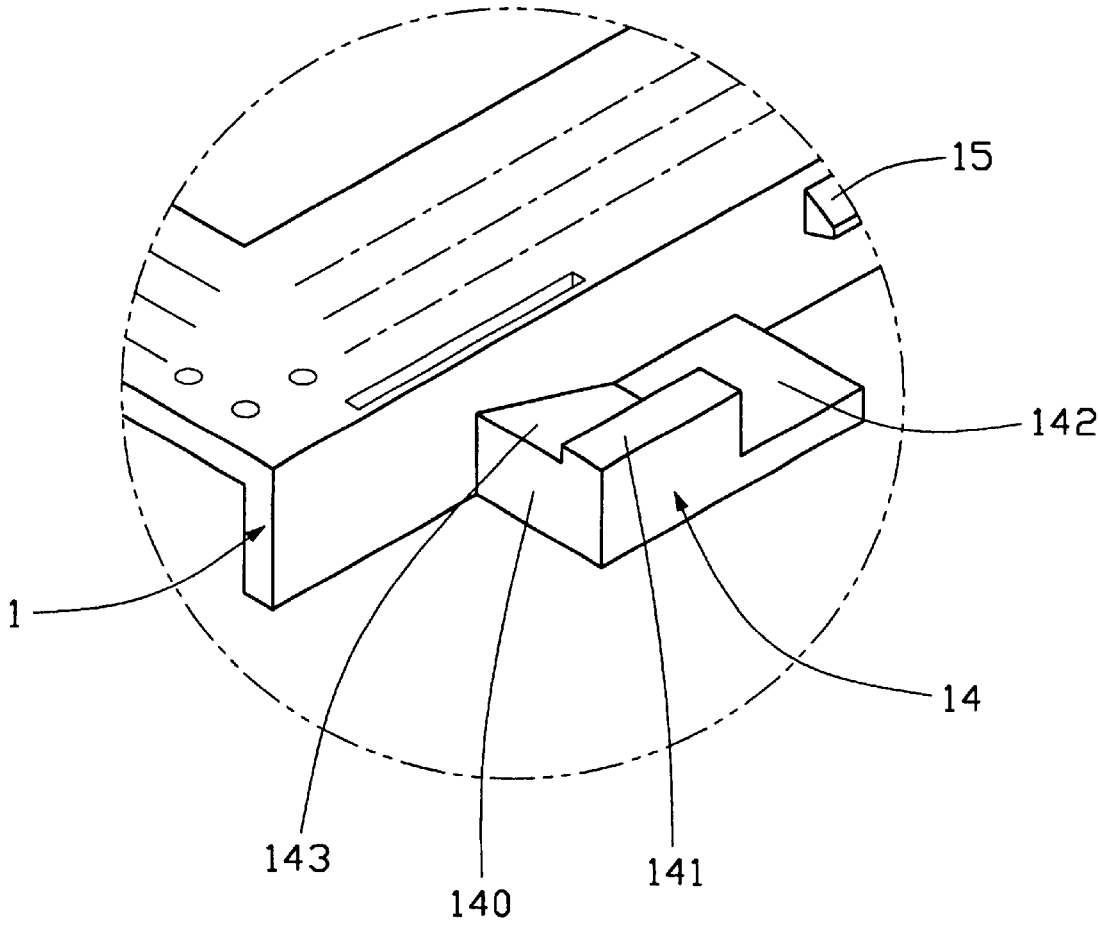
FIG. 2 is an enlarged partial view of a cover of the ZIF socket shown in FIG. 1.

The cover 1 covering the base 2 has a top face 10, a bottom face 11, and a pair of side walls 12 extending verticaly from opposite ends of the bottom face 11. A projecting member 13 perpendicular to the side walls 12 projects from a side edge of the top face 10 with an engaging portion 131 being defined thereof for engaging to corresponding part of the lever mechanism 3. A supporting piece 14 is provided on outside of one side wall 12. Referring to FIG. 2, the supporting piece 14 has a platform 142 at one end thereof and an inclined plane 140 at the other end thereof. A restriction lug 141 projects upwardly from the inclined plane 140 with a channel 143 being defined between the restriction lug 141 and the side wall 12. The side wall 12 having the supporting piece 14 further defines a projection 15 on an outside thereof and each side wall 12 defines a pair of recesses (not shown) at an inside thereof for slidably receiving the corresponding elongate blocks 212 therein. A plurality of through holes 16 are defined from the top face 10 to the bottom face 11 for communicating with the passageways 210 of the base 2.

Figure 3:
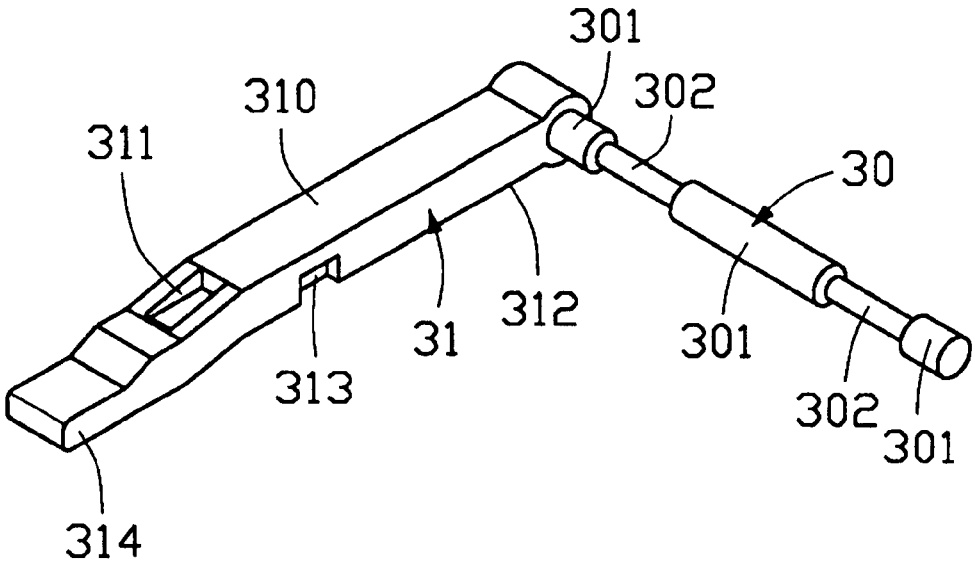
FIG. 3 is a bottom perspective view of a lever mechanism shown in FIG. 1.

Referring to FIG. 3, the lever mechanism 3 is substantially L-shaped and comprises a manual lever 31 and a cam shaft 30 vertical thereto. The cam shaft 30 is provided with three round pivoting portions 301 at intervals spaced by a pair of driven portions 302. The manual lever 31 is quite similar to a cuboid and connects to the cam shaft 30 at an end thereof opposite to a free end 314. The free end 314 is a little thinner than other part of the lever 31 and parallel to an upper face 312 and a lower face 310 formed on the manual lever 31. The lower face 310 defines a rectangular recess 311 thereon for receiving the restriction lug 141 and the upper face 312 defines a cutout 313 at an edge thereof for retaining the projection 15 of the cover 1 therein. A width of the rectangular recess 311 is larger than that of the restriction lug 141 to provide a margin for the restriction lug 141 to be inserted thereinto easier.

Figure 4:
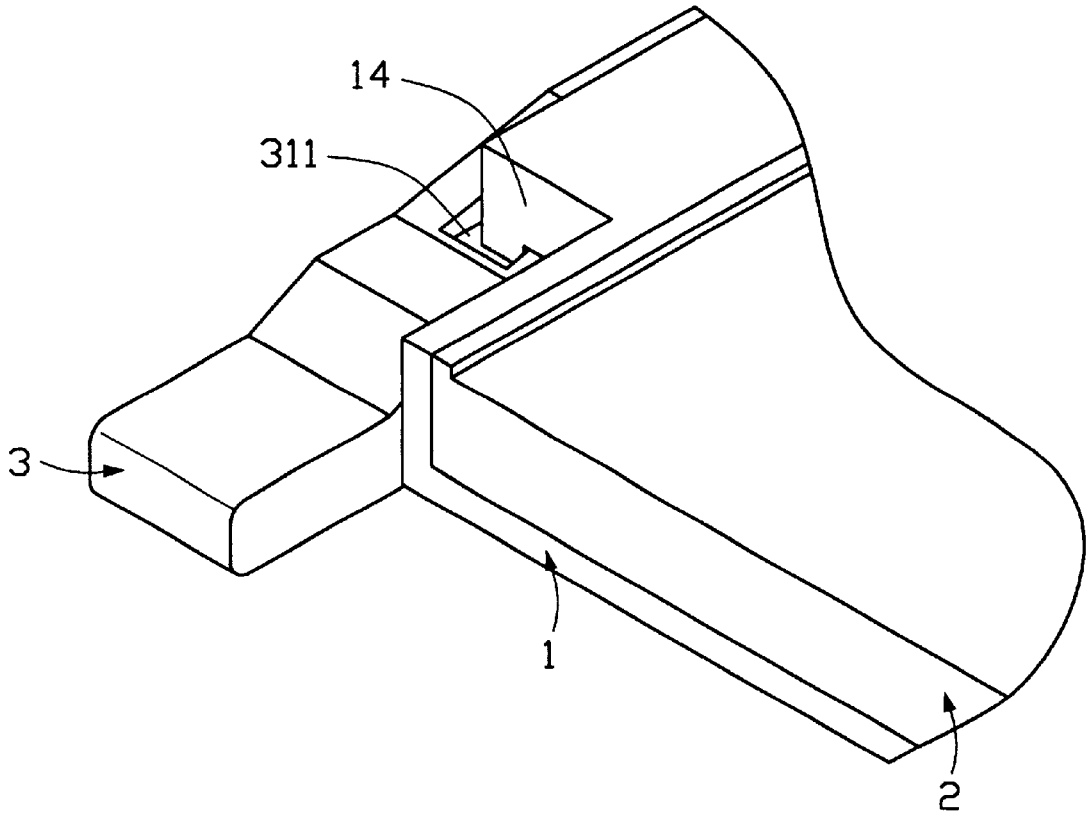
FIG. 4 is an enlarged partial view of an assembled ZIF socket being in a closed state.

In assembly, referring to FIG. 1 and FIG. 4, firstly, the cam shaft 30 is placed in the rounded channel 220 of the receiving portion 22 of the base 2. Then, the cover 1 is movably assembled on the base 2 and covers the base 2 through the bottom face 11 thereof, whereby the cam shaft 30 is sandwiched between the engaging portion 131 of the cover 1 and the receiving portion 22 of the base 2. When the manual lever 31 is located in a direction vertical to the cover 1, a chip (not shown), e.g. a Central Processing Unit chip, can be attached on the socket 100 by inserting a plurality of terminals hereof into the passageways 210 of the base 2 through the through holes 16 of the cover 1 without inserting force. Upon rotating the manual lever 31 to a horizontal position, the pivoting portions 301 rotates in the engaging portion 131, and the driven potions 302 rotate together with the pivoting portions 301 and drive the cover 1 to slide on the base 2. When the manual lever 31 is in a horizontal position, the restriction lug 141 of the supporting piece 14 is received in the rectangular recess 311 of the manual lever 31 and protects the manual lever 31 from moving along a lateral direction, thereby protecting the lever mechanism 3 from being damaged.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. Understandably, the spirit of the invention is to provide means for restricting lateral movement of the manual lever 31 relative to the base 2 (or the cover 1) when the manual level 31 is in the horizontal position. Thus, any configurations of portions provided by the manual level 31 and by the supporting piece 14 both of which generally comply with and engage each other for restricting outwardly lateral mutual movement of the manual level 31 relative to the base 2 when the manual level 31 is in a horizontal position, are intentionally included in the scope of the appended claims.

What is claimed is:

1. A ZIF socket comprising:

an insulating base receiving a plurality of contacts therein;

a cover slidably mounted to the base along a front-to-back direction and defining a side wall, the side wall having a supporting piece, a restriction portion projecting from the supporting piece, a channel being defined between the side wall and the restriction portion of the supporting piece;

a lever mechanism having a manual lever and a cam shaft connected to the manual lever, said manual level being rotatable about the cam shaft, the manual lever defining a recess engaging with the restriction portion of the cover to prevent the manual lever from moving along a lateral direction perpendicular to said front-to-back direction, when said manual lever is in a horizontal position; and a projection defined outside the side wall and a cutout defined in the manual lever for engaging with the projection so as to support and retain the manual lever in a closed state; wherein a width of the restriction portion is smaller than that of the recess; wherein the manual level is seated upon the supporting piece when said manual level is in the horizontal position.

* * * * *